US007112004B2

(12) United States Patent
Alberson et al.

(10) Patent No.: US 7,112,004 B2
(45) Date of Patent: Sep. 26, 2006

(54) HYBRID ENERGY ABSORBING REUSABLE TERMINAL

(75) Inventors: Dean C. Alberson, Bryan, TX (US); D. Lance Bullard, Jr., College Station, TX (US); Christopher J. Karpathy, Dallas, TX (US); John F. Carney, III, Falmouth, MA (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 10/967,886

(22) Filed: Oct. 18, 2004

(65) Prior Publication Data

US 2005/0084328 A1 Apr. 21, 2005

Related U.S. Application Data

(63) Continuation of application No. 10/091,838, filed on Mar. 6, 2002.

(51) Int. Cl.
*E01F 15/00* (2006.01)

(52) U.S. Cl. ..... 404/6; 404/10

(58) Field of Classification Search ..... 404/6, 404/10; 118/372; 256/13.1
See application file for complete search history.

(56) References Cited

U.S. PATENT DOCUMENTS

| | | | | |
|---|---|---|---|---|
| 3,643,924 | A | 2/1972 | Fitch | 256/13.1 |
| 3,693,940 | A | 9/1972 | Kendall et al. | 256/1 |
| 3,768,781 | A | 10/1973 | Walker et al. | 251/1 |
| 3,856,268 | A | 12/1974 | Fitch | 256/13.1 |
| 3,919,380 | A | 11/1975 | Smarook et al. | 264/164 |
| 3,982,734 | A | 9/1976 | Walker | 256/13.1 |
| 4,084,914 | A * | 4/1978 | Humphrey et al. | 404/10 |
| 4,190,275 | A | 2/1980 | Mileti | 293/102 |
| 4,200,310 | A | 4/1980 | Carney, III | 280/784 |
| 4,307,973 | A * | 12/1981 | Glaesener | 404/6 |
| 4,352,484 | A | 10/1982 | Gertz et al. | 256/13.1 |
| 4,399,980 | A | 8/1983 | van Schie | 256/13.1 |
| 4,452,431 | A | 6/1984 | Stephens et al. | 256/13.1 |
| 4,583,716 | A | 4/1986 | Stephens et al. | 256/13.1 |
| 4,596,489 | A * | 6/1986 | Mariol et al. | 404/10 |
| 4,645,375 | A | 2/1987 | Carney, III | 404/6 |
| 4,674,911 | A | 6/1987 | Gertz | 404/6 |
| 4,784,515 | A | 11/1988 | Krage et al. | 404/6 |
| 4,815,565 | A | 3/1989 | Sicking et al. | 404/6 |
| 4,844,213 | A * | 7/1989 | Travis | 188/377 |
| 5,011,326 | A | 4/1991 | Carney, III | 404/6 |
| 5,054,954 | A | 10/1991 | Cobb et al. | 404/6 |
| 5,112,028 | A | 5/1992 | Laturner | 256/13.1 |
| 5,248,129 | A | 9/1993 | Gertz | 256/13.1 |

(Continued)

*Primary Examiner*—Gary S. Hartmann
(74) *Attorney, Agent, or Firm*—Baker Botts L.L.P.

(57) ABSTRACT

An energy absorbing terminal is described that is made up of a plurality of cells partially defined by cambered panels made of thermoplastic or another suitable material. The panels are supported upon rectangular frames. The cambered portion of the panels provides a predetermined point of flexure for each panel and, thus, allows for energy dissipation during a collision. The stiffness of the crash cushion may be varied by altering material thicknesses and diaphragm spacing. In operation, a vehicle colliding in an end-on manner with the upstream end of the energy absorbing terminal will cause each of the cambered panels to bend angularly at its point of flexure and, thus, cause the cells to collapse axially. The use of thermoplastic, such as polyethylene results in a reversible, self-restoring collapse for the terminal, meaning that the terminal is reusable after most collisions.

3 Claims, 4 Drawing Sheets

U.S. PATENT DOCUMENTS 5,403,112 A 4/1995 Carney, III ..... 404/6
5,718,413 A * 2/1998 Nagler ..... 256/13.1
5,733,062 A 3/1998 Oberth et al. ..... 404/6
5,746,419 A 5/1998 McFadden et al. ..... 267/140
5,775,675 A 7/1998 Sicking et al. ..... 256/13.1
5,797,592 A 8/1998 Machado ..... 256/13.1
5,823,584 A 10/1998 Carney, III ..... 293/102
5,851,005 A 12/1998 Muller et al. ..... 256/13.1
5,868,521 A * 2/1999 Oberth et al. ..... 404/6
5,957,435 A 9/1999 Bronstad ..... 256/13.1
6,092,959 A 7/2000 Leonhardt et al. ..... 404/6
6,116,805 A 9/2000 Gertz ..... 256/13.1
6,203,079 B1 3/2001 Breed ..... 293/119
6,220,575 B1 4/2001 Lindsay et al. ..... 256/13.1
6,276,667 B1 * 8/2001 Arthur ..... 256/13.1
6,293,727 B1 * 9/2001 Albritton ..... 404/6
6,308,809 B1 10/2001 Reid et al. ..... 188/377
6,340,268 B1 1/2002 Alberson et al. ..... 404/6
6,461,076 B1 10/2002 Stephens et al. ..... 404/6
6,533,250 B1 * 3/2003 Arthur ..... 256/13.1
6,536,985 B1 * 3/2003 Albritton ..... 404/6
6,551,010 B1 * 4/2003 Kiedaisch et al. ..... 404/6
6,637,971 B1 10/2003 Carney, III et al. ..... 404/6
6,863,467 B1 * 3/2005 Buehler et al. ..... 404/6

* cited by examiner

HYBRID ENERGY ABSORBING REUSABLE TERMINAL

CROSS REFERENCE TO RELATED APPLICATIONS

This application is a continuation of U.S. Patent Application Ser. No. 10/091,838 filed by Dean C. Alberson, et al., on Mar. 6, 2002, which is hereby incorporated by reference.

TECHNICAL FIELD OF THE INVENTION

The present invention relates generally to crash cushions and terminals used in highway applications to mitigate and preclude injuries to occupants of errant vehicles.

BACKGROUND OF THE INVENTION

Roadway crash cushions are widely used to absorb impacts and decelerate impacting vehicles in a controlled manner. Typically, crash cushions are positioned to shield fixed objects located within the roadway environment. Crash cushions are often positioned in front of obstacles such as concrete columns and abutments. Also, crash cushions are often located at the end of a guardrail installation to prevent the upraised end of the guardrail from spearing an impacting vehicle.

There are numerous crash cushions designs known that rely upon frangible members, or members that are intended to shatter or be destroyed upon impact, to absorb the energy associated with a vehicular impact. Examples are found in U.S. Pat. Nos. 3,768,781 issued to Walker et al. and 3,982,734 issued to Walker (both employing energy cells having internal frangible members of e.g., vermiculite). One problem with the use of frangible members is the crash cushion must be completely replaced after each collision. Thus, time and expense is incurred in replacing the frangible members.

A number of previous crash cushion designs rely upon the permanent deformation of plastics or steels to absorb the kinetic energy of errant impacting vehicles. A design of that nature suffers from the same drawbacks as those designs incorporating frangible members. The cost and time associated with replacing or repairing the deformed portions of the cushion is significant.

There have been a few attempts to provide reusable or restorable crash cushions. However, for the most part, these attempts have proven impractical or unworkable in practice, U.S. Pat. No. 4,452,431 issued to Stephens et al, for instance, describes a crash cushion wherein fluid filled buffer elements are compressed during a collision. It is intended that energy be absorbed as the fluid is released from the buffer elements under pressure. In practice, it is difficult to maintain the fluid filled cylinders as they are prone to loss of fluid through evaporation, vandalism and the like. Also, after a sever impact, holes or puncture may occur in the buffer elements rendering them incapable of holding fluid.

U.S. Pat. No. 4,674,911 issued to Gertz describes a pneumatic crash cushion that is intended to be reusable. This crash employs a plurality of air chambers and valve members to absorb and dissipate impact energy. This arrangement is relatively complex and prone to failure. In addition, the numerous specialized components used in its construction make it expensive.

The Reusable Energy Absorbing Crash Terminal ("REACT") 350 is a crash cushion wherein a plurality of polyethylene cylinders are used to absorb impact energy. The cylinders are retained within a framework of side cables and supporting frames. This system is effective and reusable to a great degree due to the ability of the cylinders to restore themselves after impact. The cylinders typically return to 85%–90% of their original shape after impact. Unfortunately, the REACT system is also expensive to construct. The number of manufacturers producing large diameter polyethylene cylinders is limited and, as a consequence, prices for the cylinders are elevated.

An improvement that addresses the problems of the prior art would be desirable.

SUMMARY OF THE INVENTION

The present invention provides devices and methods relating to roadway crash cushions. An energy absorbing terminal is described that is made up of a plurality of cells partially defined by cambered panels made of thermoplastic. The panels are supported upon steel diaphragms. The cambered portion of the thermoplastic panels provides a predetermined point of flexure for each panel and, thus, allows for energy dissipation during a collision. The stiffness of the crash cushion is variable by altering material thicknesses and diaphragm spacing.

In operation, a vehicle colliding in an end-on manner with the upstream end of the energy absorbing terminal will cause the cambered panels to bend angularly at their points of flexure and, thus, cause the cells to collapse axially. The use of thermoplastic, such as polyethylene, results in a reversible, self-restoring collapse of the terminal, meaning the terminal is reusable after most collisions.

The invention provides a number of advantages over conventional crash cushions, including cost, ease of construction, and maintenance.

DETAILED DESCRIPTION OF THE INVENTION

Figure 1:
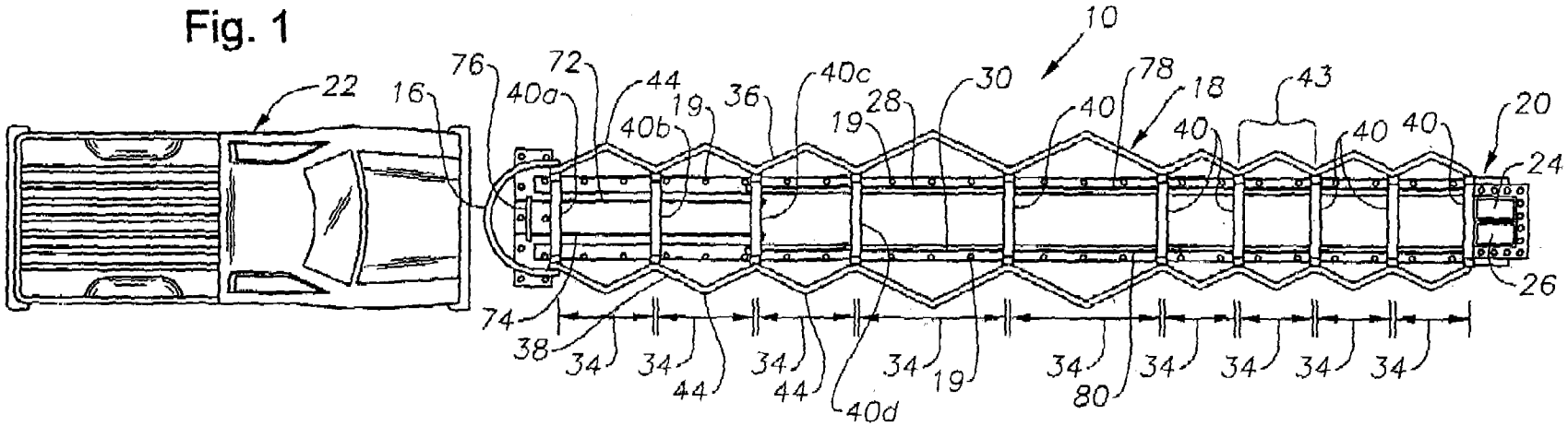
FIG. 1 is a plan view of an example crash cushion arrangement constructed in accordance with the present invention prior to impact from an errant vehicle.
Figure 2:
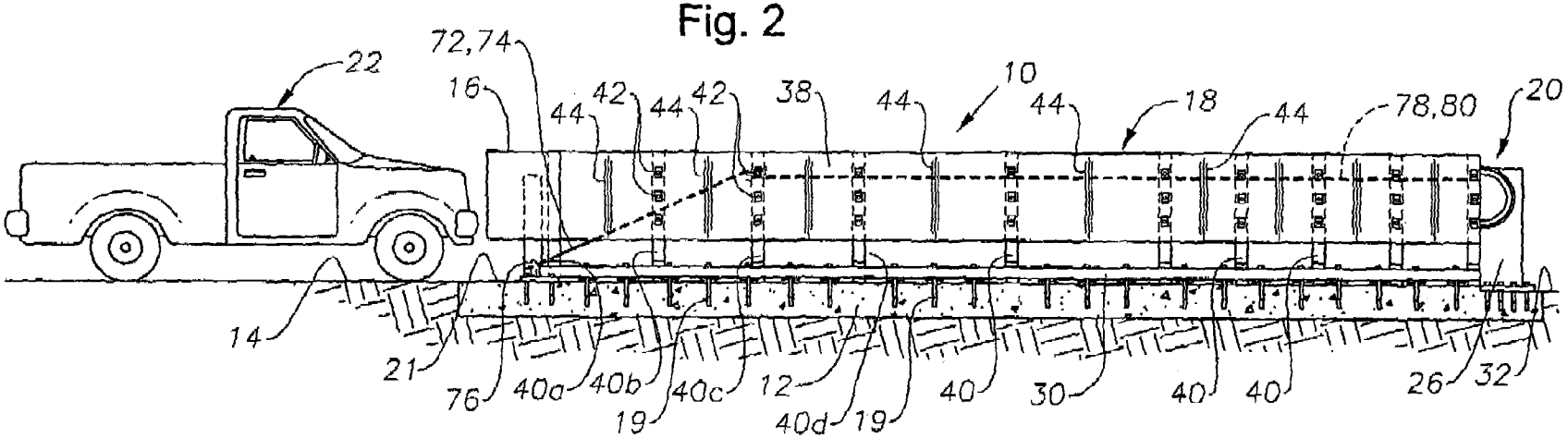
FIG. 2 is a side view of the arrangement depicted in FIG. 1.
Figure 3:
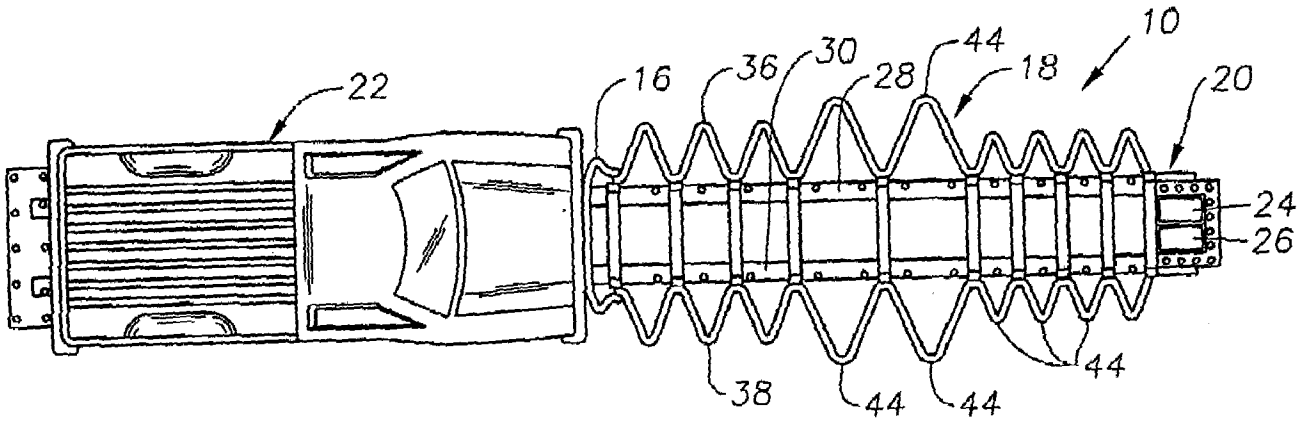
FIG. 3 is a plan view of the crash cushion depicted in FIGS. 1 and 2 after being struck by an impacting vehicle.

FIGS. 1–3 illustrate an example hybrid energy absorbing reusable terminal (37 HEART") crash cushion 10 that is constructed in accordance with the present invention. The crash cushion 10 is shown installed on a concrete pad 12

(visible in FIG. 2) that has been placed within a section of ground 14. Although not shown, it should be understood that the crash cushion 10 is typically installed adjacent a rigid obstacle, such as a bridge abutment, concrete post or other barrier. In addition, the crash cushion 10 may be located at the upstream end of a guardrail installation.

The crash cushion 10 includes a nose portion 16, central body portion 18 and downstream end portion 20. An approaching vehicle 22 is shown adjacent the nose portion 15 of the cushion 10 in FIGS. 1 and 2. The nose portion 16 consists of a sheet of plastic, or other suitable material, that is curved or bent into a "u" shape. The nose portion 16 may be painted with a bright color, such as yellow, or have reflective tape applied so that the cushion 1 0 may be easily recognized by drivers. The downstream end portion 20 includes a pair of upstanding rigid posts 24, 26 that are typically formed of concrete or steel and are securely anchored, either to the ground 32 or to an adjacent abutment, post or other barrier (not shown).

The central body portion 18 also includes a steel basetrack formed from a pair of parallel rail members 28, 30 that are attached to the ground 32. Anchor members 19, such as bolts, are typically used to ensure the rail members 28,30 to a concrete slab 21. The central body portion 18 features a plurality of openings 34 that are arranged linearly along the length of the cushion 10. In the described embodiment, the openings 34 are shown to be hexagonally shaped. While the hexagonal shape is presently preferred, it should be understood that other suitable shapes may be used, including, for example, octagonal, rectangular and square. The central body portion 18 incorporates two substantially parallel rows 36, 38 of cambered panels that are arrayed in an end-to end manner along their lengths. The panel rows 36, 38 may comprise a single integrally formed sheet of plastic. Alternatively, they may be formed of a number of individual cambered panels members placed in an end-to-end, adjoining manner at each rectangular frame 40. It is presently preferred that the rows of panel members 36, 38 be formed of polyethylene. A suitable polyethylene material for use in this application is PPI recommended designation PE3408 high molecular weight, high density polyethylene. A currently preferred thickness for the panel members 36, 38 is approximately 1 ¼". It is noted that the panel members 36, 38 are created so as to be substantially stiff and sturdy in practice and to possess substantial "shape memory" so that they tend to substantially return to their initial form and configuration following elastic deformation. Presently, panel members having a secured in place height of about 20 inches have provided suitable resistance to collapse and sufficiently return to original shape. It is noted that the thickness of a given panel member as well as its height may be adjusted as desired to increase or decrease resistance to expected end-on collision forces. For example, increasing the height of the panel members 36, 38 will increase the amount of panel material that would be bent by a colliding vehicle and would, therefore, be stiffer than a cushion that incorporated panel members of lesser height.

Figure 4:
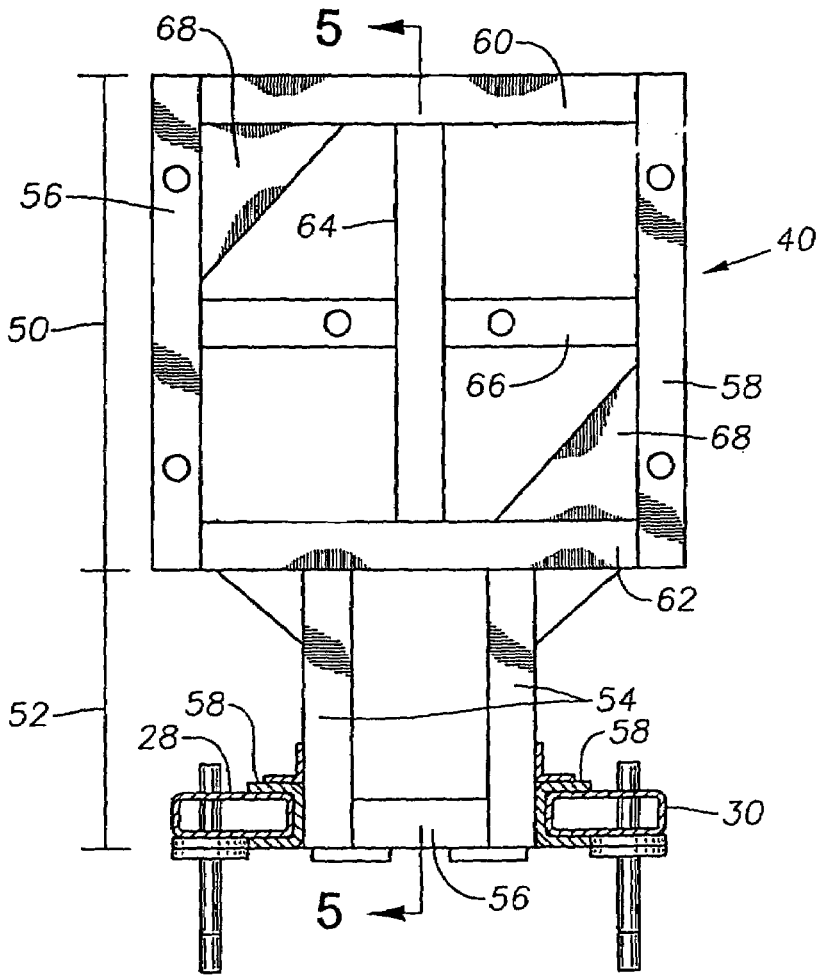
FIG. 4 is a front view of a diaphragm used within the crash cushion shown in FIGS. 1, 2, and 3.
Figure 5:
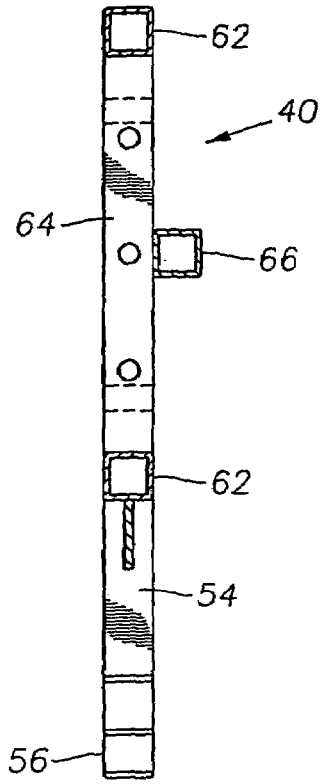
FIG. 5 is a side view of the diaphragm shown in FIG. 4.
Figure 6:
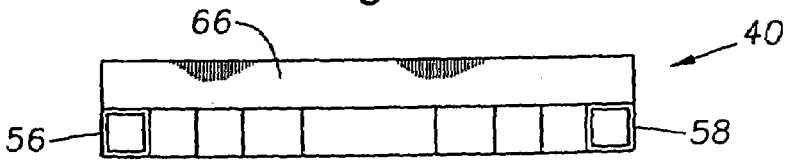
FIG. 6 is a plan view of the diaphragm shown in FIGS. 4 and 5.

The crushable cells include rectangular frames or diaphragms 40 that join the parallel panel rows 36, 38 together. In the drawings, individual diaphragms are designated consecutively from the upstream end of the cushion 10 as diaphragms 40*a*, 40*b*, 40*c*, etc. The diaphragms 40 are preferably formed of steel box beam members welded to one another. In a currently preferred construction, bolts or rivets 42 (visible in FIG. 2) are used to affix the panel rows 36, 38 to the frames 40. Referring now to FIGS. 4–6, a single exemplary diaphragm, or frame, 40 is shown in greater detail. The diaphragm 40 includes a widened upper portion, generally shown at 50, and a narrower lower portion 52. The lower portion 52 includes a pair of generally vertically oriented support members 54 and a connecting cross-piece 56. U-shaped engagement shoes 58 are secured to one side of each of the support members 54 and slidably engage the rail members 28, 30. The upper portion 50 includes a pair of vertically disposed side members 56, 58 with upper and lower cross-members 60, 62 that interconnect the side members 56, 58 to form a rectangular frame. Additional vertical and horizontal cross-members 64, 66, respectively, are secured to one another within the rectangular frame for added support. Plate gussets 68 are welded into each comer of the rectangular upper portion 50 in order to help to maintain rigidity and stiffness for the diaphragm 40.

Tension cables are used to provide the crash cushion additional strength and stability and, thereby, materially assist in the lateral redirection of side impacts into the cushion 10. As shown in FIGS. 1 and 2, a pair of forward, or upstream, tension cables 72, 74 are disposed through a forward plate 76, threaded through the upstream diaphragms 40*a*, 40*b* and are then secured to the third diaphragm 40*c*. A currently preferred method of securing the tension cables to a diaphragm is to secure a threaded end cap (not shown) onto each end of cable and then thread a nut onto the end cap after passing the end cap through an aperture in the diaphragm. In the exemplary construction shown, a pair of rearward tension cables 78, 80 are secured to the third diaphragm 40*c* and extend rearwardly through corresponding diaphragm apertures toward the downstream end of the central portion 18.

Longitudinal tension in the cushion 10 is provided by the side panels 36, 38 that tend to want to remain in a substantially flattened (unfolded) configuration due to shape memory. As noted, prebending of the panels is done to provide a point of planned bending for the panels 36,38 at the cambered portions 44.

Figure 7:
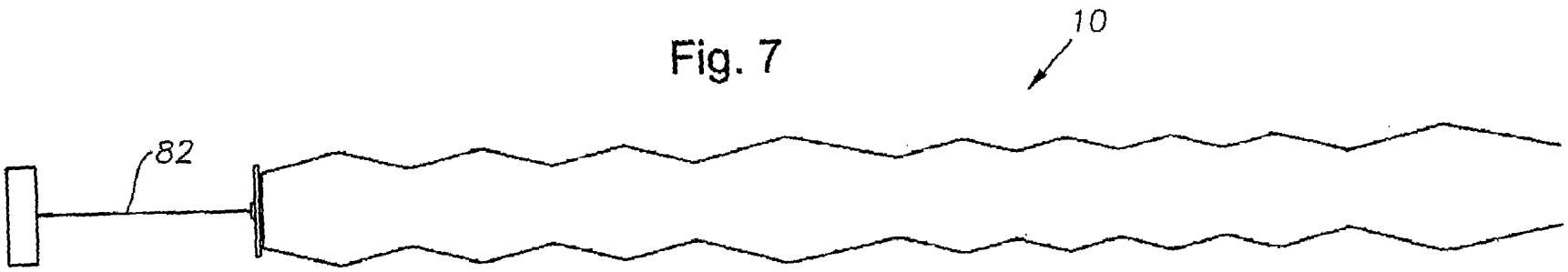
FIG. 7 is a schematic depiction of an exemplary crash cushion shown prior to an end on impact by a vehicle.
Figure 8:
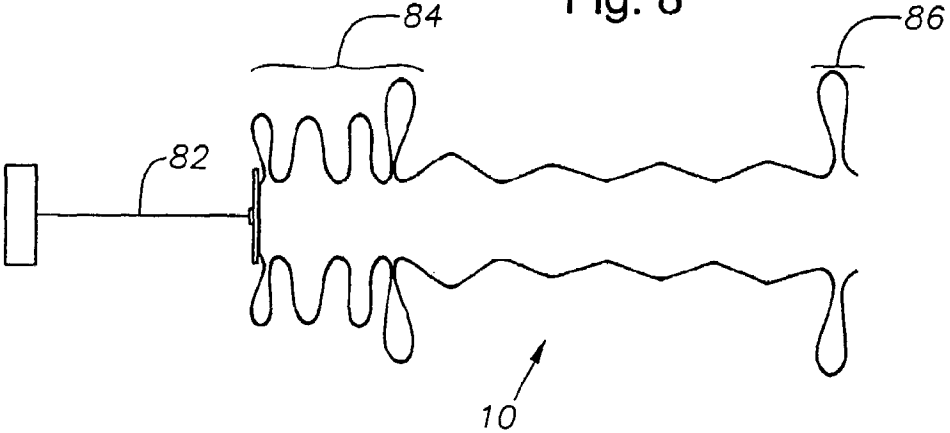
FIG. 8 is a schematic depiction of the crash cushion shown in FIG. 7, at approximately 0.18 seconds following an end-on impact.
Figure 10:
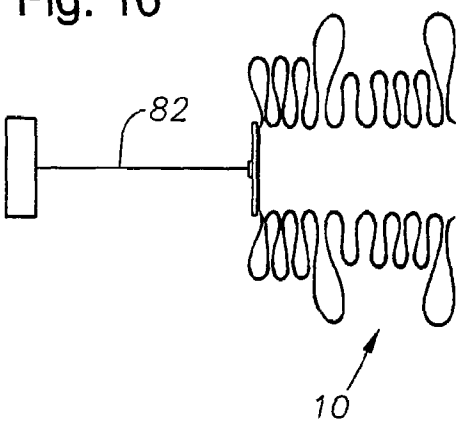
FIG. 10 is a schematic depiction of the crash cushion shown in FIG. 7, at approximately 0.345 seconds following an end-on impact.
Figure 9:
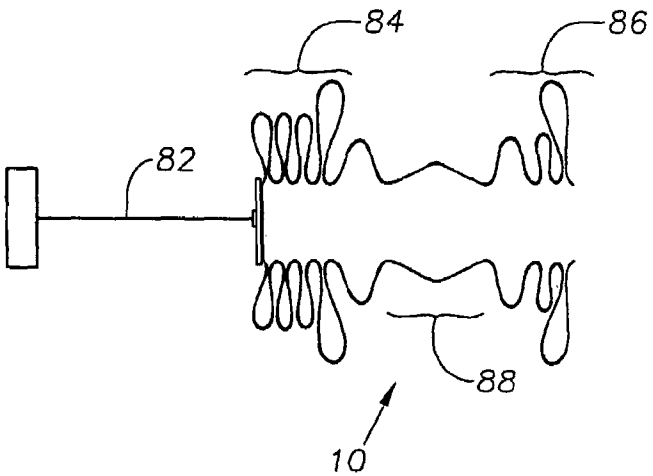
FIG. 9 is a schematic depiction of the crash cushion shown in FIG. 7, at approximately 0.27 seconds following an end-on impact.

FIGS. 7–10 are schematic representations of a crash cushion constructed in accordance with the present invention and illustrate the mechanics of collapse over time. In FIG. 7, the cushion 10 has not yet been collapsed by an end on impact. Thus, the cushion 10 is at rest, and in a fully extended position. In FIG. 8, an end on collision has taken place. The cushion 10 has been impacted by a vehicle (small car), shown schematically as load 82, traveling at approximately 62 mph. The cushion 10 is shown at approximately 1.8 seconds into the collision in FIG. 8. As can be seen, the cushion 10 has begun to collapse at two primary locations along its length. One of the locations 84 is proximate the upstream end of the cushion 10. The second location 86 is proximate the downstream end of the cushion 10. In FIG. 9, the cushion 10 is shown approximately 0.27 seconds after the impact. By this time, a third location 88 of axial collapse has begun to form. This third location 88 is proximate the central point along the length of the cushion 10. In FIG. 10, the cushion 10 is essentially completely crushed or collapsed.

There are significant advantages to a system that provides for separate collapsing portions spread out in terms of location upon the cushion as well as time. These advantages include efficient use of material and aid in self-restoring nature of cushion. A collapse concentrated in one point along the length could cause that portion of the cushion 10 to be inelastically damaged.

As noted, the cells 34 may be hexagonal, octagonal, rectangular or square in shape, being formed between two adjacent frames 40 and the two panel rows 36,38. As shown in FIG. 1, the cells 34 need not all be the same size. The different lengths of the cells provides for differing resistance to collapse. The frames 40 have rollers or shoes (not shown) that engage the rails 28, 30 in a manner known in the art so that the frames 40 may move longitudinally along the rails 28, 30. During an end-on collision with the crash cushion 10, there is a dynamic wave that propagates through the cushion 10 and may collapse sections other that the lead sections (defined between the upstream frame 40*a*, 40*b*, 40*c*, and 40*d*). Additionally, some inertial properties can be used by collapsing the segments in varying order.

It is noted that each of the panel segments, such as segment 43 of each row 36, 38 are cambered at a point 44 approximately midway between adjacent frames 40. This cambered portion 44 forms a point of flexure and preplanned weakness for the panel segment 43, thereby permitting the segment 43 to collapse upon the application of an end-on force. The bend also prevents large acceleration spikes from being needed for initial column buckling of the segments 43. Currently, it is preferred that the amount of bend at the cambered point 44 be about 5–10 degrees, as this amount of bend has been found to provide enough eccentricity to assure proper buckling. The bend at the cambered point 44 may be formed by using a press device of a type known in the art.

In operation, the cells 34 are substantially, reversably compressed during an end-on impact by a vehicle 22. The use of a resilient, thermoplastic material, such as polyethylene, ensures that the terminal 10 will be self-restoring after minor end-on impacts. The nose 16 may be crushed during the impact, but should be easily replaceable. The posts 24, 26 serve as a reinforcement portion at the downstream end of the terminal 10. The central portion 18 is compressed against the posts 24, 26.

The terminal 10 of the present invention provides a number of advantages over prior art terminals. The first is cost. As compared to systems that incorporate polyethylene cylinders, suitable sheets of polyethylene may be obtained readily and inexpensively from a number of suppliers. Secondly, if it becomes necessary to replace one or more of rows 36 or 38, or individual panels 43 within those rows, this may be accomplished quickly and easily, requiring only removal and replacement of the fasteners 42 used to secure them to the frames 40.

Those of skill in the art will recognize that many changes and modifications may be made to the devices and methods of the present invention without departing from the scope and spirit of the invention. Thus, the scope of the invention is limited only by the terms of the claims that follow and their equivalents.

What is claimed is:

1. A roadway crash cushion comprising:

a collapsible, substantially self-storing collapsing portion comprising a pair of panels formed substantially of a thermoplastic material, the panels each being cambered by a bend in the panel, the panels being spaced apart such that a collapsible cell is formed between the panels;

at least one substantially rectangular supporting frame that is secured to each of the panels; and a longitudinal, ground-mounted rail member and wherein the supporting frame engages the rail member for slidable movement along the rail member.

2. The roadway crash cushion of claim 1, wherein the thermoplastic material comprises polyethylene.

3. The roadway crash cushion of claim 1, wherein the bend provides a point of flexure for the panel.

* * * * *